US007617770B2

(12) United States Patent
Ohdaira et al.

(10) Patent No.: US 7,617,770 B2
(45) Date of Patent: Nov. 17, 2009

(54) STENCIL PRINTING APPARATUS CAPABLE OF DUPLEX PRINTING

(75) Inventors: Masaru Ohdaira, Miyagi (JP); Toshiharu Hasegawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 11/965,207

(22) Filed: Dec. 27, 2007

(65) Prior Publication Data

US 2008/0178754 A1 Jul. 31, 2008

(30) Foreign Application Priority Data

Jan. 25, 2007 (JP) ..... 2007-015080

(51) Int. Cl.
*B41L 13/04* (2006.01)

(52) U.S. Cl. ..... 101/118; 101/116; 101/484

(58) Field of Classification Search ..... 101/116, 101/118

See application file for complete search history.

(56) References Cited

U.S. PATENT DOCUMENTS 6,718,872 B2 * 4/2004 Kanno ..... 101/118
7,188,564 B2 * 3/2007 Ashikagaya ..... 101/118

FOREIGN PATENT DOCUMENTS

JP 2003-200645 7/2003
JP 2003-237207 8/2003
JP 2004-196476 7/2004

* cited by examiner

*Primary Examiner*—Leslie J Evanisko
(74) *Attorney, Agent, or Firm*—Oblon, Spivak, McClelland, Maier & Neustadt, L.L.P.

(57) ABSTRACT

In a stencil printing apparatus capable of duplex printing, in which a front surface printing process for printing a front surface image on one surface of a sheet of paper fed by a sheet feeding unit is performed, the sheet is re-fed to a sheet re-feeder, and then a rear surface printing process for printing a rear surface image on the other surface is performed. The positions of the front surface image and rear surface image to be formed on the sheet can be moved together by a predetermined amount in a single direction side of a sheet conveyance direction.

10 Claims, 4 Drawing Sheets

STENCIL PRINTING APPARATUS CAPABLE OF DUPLEX PRINTING

BACKGROUND OF THE INVENTION

1. Field of the Invention

The present invention relates to a stencil printing apparatus having sheet re-feeding means so as to be capable of duplex printing.

2. Description of the Related Art

Digital thermal stencil printing is known in the related art as a simple printing method. In digital thermal stencil printing, a thermal head having a plurality of minute heat-generating elements is brought into contact with a master formed by adhering together a thermoplastic resin film and a porous support, and while pulse-form electrification is applied to the heat-generating elements, the master is conveyed by conveyance means such as a platen roller, whereby a perforated image based on image information is engraved by heat-melt punching on the thermoplastic resin film of the master. The engraved master is then wrapped around a porous cylindrical printing cylinder, and by pressing a sheet of paper against the outer peripheral surface of the printing cylinder using pressing means such as a press roller, ink supplied to the inner peripheral surface of the printing cylinder seeps through open hole portions in the printing cylinder and the perforated portions of the master so as to be transferred onto the sheet, whereby a printed image is formed on the sheet.

In the stencil printing described above, duplex printing, in which both surfaces of the sheet are printed, is performed with increasing frequency in recent times with a view to reducing paper consumption, document storage space and so on. As an example of this, Japanese Unexamined Patent Application Publication 2004-196476 discloses a stencil printing apparatus that uses a divided engraved master on which a first engraved image and a second engraved image are arranged in surface order in a rotation direction of a printing cylinder. One of the engraved images is printed on the front surface of a first sheet of paper fed by a sheet feeding unit, after which the sheet is guided to an auxiliary tray. One of the engraved images is then printed on the front surface of a second sheet of paper fed by the sheet feeding unit, whereupon the sheet is guided to the auxiliary tray. The first sheet is then re-fed from the auxiliary tray and the other engraved image is printed on the rear surface of the sheet, whereupon the sheet is discharged to a discharge tray. By performing this operation continuously, duplex printed matter is obtained in a single process.

In the stencil printing apparatus disclosed in the publication described above, the positions of the front surface image and rear surface image that are printed on the sheet can be adjusted individually by a predetermined amount. Here, when the positions of the images to be formed on the sheet are moved to an identical direction side in the sheet conveyance direction, the front surface side and rear surface side of the sheet move in opposite directions when the sheet is viewed from above, and therefore, if the front surface image is moved 3 mm toward the upstream side of the sheet conveyance direction, for example, setting must be performed to move the rear surface image 3 mm toward the downstream side in the sheet conveyance direction, and this setting is both troublesome and likely to be performed incorrectly. Further, even if the images are moved together to secure a binding margin or the like, for example, after the positions of the front surface image and rear surface image have been adjusted individually, positional adjustment must be performed on each image, and this operation is also troublesome.

Technologies relating to the present invention are also disclosed in, e.g. U.S. Pat. No. 6,718,872 (corresponding to Japanese Unexamined Patent Application Publication 2003-200645) and Japanese Unexamined Patent Application Publication 2003-237207.

SUMMARY OF THE INVENTION

It is an object of the present invention to solve each of the problems described above by providing a stencil printing apparatus with which positions of a front surface image and a rear surface image to be printed on a sheet of paper can be moved together.

In an aspect of the present invention, a stencil printing apparatus is capable of performing duplex printing in which a front surface printing process for printing a front surface image on one surface of a sheet fed by a sheet feeding unit is performed, the sheet is re-fed, and then a rear surface printing process for printing a rear surface image on the other surface of the sheet is performed. The stencil printing apparatus comprises a printing unit having a printing cylinder and pressing means provided to be free to contact and separate from said printing cylinder; the sheet feeding unit for feeding the sheet toward the printing unit; and sheet re-feeding means for temporarily accommodating the sheet after a printed image is formed on the front surface thereof in the printing unit, and then re-feeding the sheet toward the printing unit. A position of the front surface image and a position of the rear surface image to be formed on the sheet can be moved together by a predetermined amount toward an identical direction side of a sheet conveyance direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

A stencil printing apparatus according to an embodiment of the present invention will be described in detail below with reference to the drawings.

Figure 1:
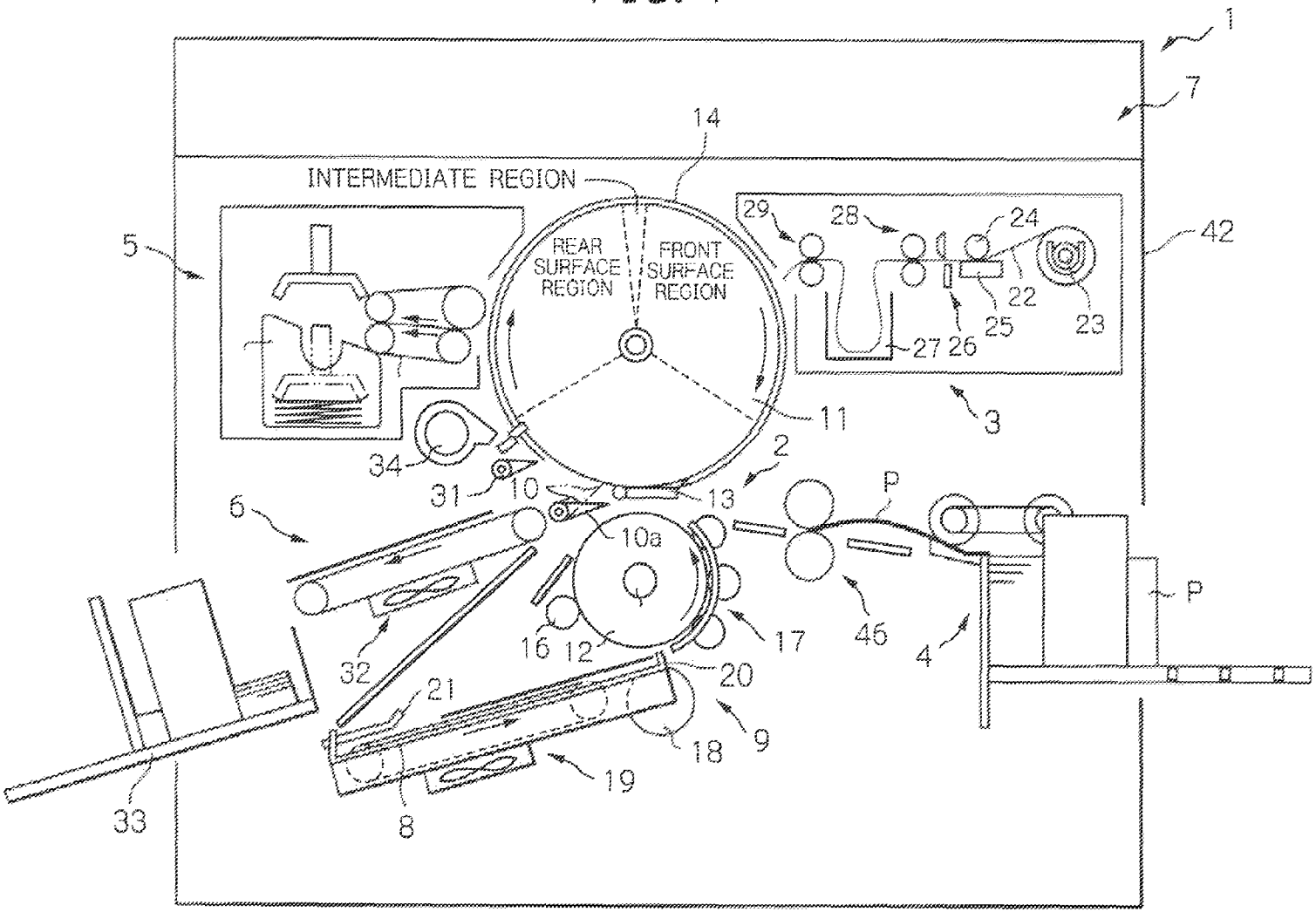
FIG. 1 is a schematic front view of a stencil printing apparatus capable of duplex printing, which employs an embodiment of the present invention.

FIG. 1 shows an outline of a stencil printing apparatus employing this embodiment. The structure of this stencil printing apparatus is related to that of the duplex printing apparatus disclosed in the aforementioned Japanese Unexamined Patent Application Publication 2003-200645, and therefore description of each part has been omitted wherever possible.

In FIG. 1, a stencil printing apparatus 1 comprises a printing unit 2, an engraving unit 3, a sheet feeding unit 4, a plate discharge unit 5, a sheet discharge unit 6, an image reading unit 7, sheet re-feeding means 9 having an auxiliary tray 8, a switching member 10 and so on.

The printing unit 2, which is disposed substantially in the center of an apparatus main body 42, comprises a printing cylinder 11 and a press roller 12 serving as pressing means. The printing cylinder 11 is supported rotatably on the apparatus main body 42, and is driven to rotate by printing cylinder driving means, not shown in the drawing. An openable damper 13 is provided on the outer peripheral surface of the printing cylinder 11. During duplex printing, a divided engraved master 14 engraved by the engraving unit 3 is wrapped around the outer peripheral surface of the printing cylinder 11. A first engraved image corresponding to a front surface image and a second engraved image corresponding to a rear surface image are formed on the divided engraved master 14, and a non-engraved part is formed between the engraved images. The divided engraved master 14 is wrapped around the printing cylinder 11 such that the first engraved image corresponds to a front surface region shown in FIG. 1, the second engraved image corresponds to a rear surface region, and the non-engraved part corresponds to an intermediate region. A rotary encoder, not shown in the drawing, for detecting the position of the printing cylinder 11 is provided near the outer peripheral surface of the printing cylinder 11. Further, similarly to an apparatus disclosed in Japanese Unexamined Patent Application Publication 2003-312112, printing cylinder axial direction moving means, not shown in the drawing, for moving the printing cylinder 11 in an axial direction thereof are provided near the printing cylinder 11.

The press roller 12 is disposed below the printing cylinder 11. The press roller 12, which is constituted by a water-repellent elastic body made of fluorine resin or the like, is supported rotatably on an arm member, not shown in the drawing, at either end, while the arm member, not shown in the drawing, is supported so as to be swingable by swinging means, not shown in the drawing. The press roller 12 selectively occupies a removed position shown in FIG. 1, in which the peripheral surface thereof is removed from the printing cylinder 11, and a pressing position, in which the peripheral surface thereof is pressed against the divided engraved master 14 on the printing cylinder 11. A cleaning roller 16 for performing cleaning by contacting the peripheral surface of the press roller 12 is disposed near the peripheral surface of the press roller 12. The cleaning roller 16 is driven to rotate by driving means not shown in the drawing.

A sheet re-feeding guidance member 17 for conveying a sheet P, which is delivered from the sheet re-feeding means 9 following printing on the front surface thereof, around the peripheral surface of the press roller 12 is disposed near the right side of the press roller 12. A sheet re-feeding resist roller 18 for feeding the sheet P from the auxiliary tray 8 such that the sheet P contacts the peripheral surface of the press roller 12 is disposed below the press roller 12. A sheet re-feeding conveyance unit 19 having the auxiliary tray 8 on its upper surface is disposed below and to the left of the press roller 12, and is formed integrally with a sheet re-feeding positioning member 20. A sheet receiving plate 21 is disposed above the sheet re-feeding conveyance unit 19 so as to be free to move along the upper surface of the auxiliary tray 8. The auxiliary tray 8, sheet re-feeding guidance member 17, sheet re-feeding resist roller 18, sheet re-feeding positioning member 20, sheet re-feeding conveyance unit 19 and sheet receiving plate 21 together constitute the sheet re-feeding means 9.

The switching member 10 is disposed to the left of the contact position between the printing cylinder 11 and the press roller 12 and on the conveyance path of the sheet P. The switching member 10 is supported rotatably on the apparatus main body 42 by an end portion thereof on the downstream side of the sheet conveyance direction, and is moved by moving means, not shown in the drawing, so as to selectively occupy a first position shown by a solid line in FIG. 1 and a second position shown by a dot-dot-dash line. When the sheet P passes between the printing cylinder 11 and press roller 12 and the switching member 10 occupies the first position, the sheet P is guided to the sheet discharge unit 6. When the switching member 10 occupies the second position, the sheet P is guided to the auxiliary tray 8.

The engraving unit 3 is disposed above and to the right of the printing unit 2. The engraving unit 3 has a well-known constitution comprising a master holding member 23 for holding a master roll on which masters 22 are wound in roll-form, a platen roller 24, a thermal head 25, master cutting means 26, a master stock unit 27, a tension roller pair 28, a reverse roller pair 29, and so on. The divided engraved master 14 is created in the engraving unit 3.

The sheet feeding unit 4 is disposed below the engraving unit 3. The sheet feeding unit 4 has a well-known constitution comprising a sheet feeding tray, a sheet feeding roller, a separating roller, a separating pad, a resist roller pair 46, and so on.

The plate discharge unit 5, which is disposed above and to the left of the printing unit 2, also has a well-known constitution comprising an upper plate discharge member, a lower plate discharge member, a plate discharge box, a compression plate and so on. Used divided engraved masters 14 are peeled away from the outer peripheral surface of the printing cylinder 11 and discarded in the plate discharge box.

The sheet discharge unit 6 is disposed below the plate discharge unit 5. The sheet discharge unit 6 comprises a peeling pawl 31, a sheet discharge conveyance unit 32, a sheet discharge tray 33, a peeling fan 34, and so on. The peeling pawl 31 is provided such that a tip end portion thereof can be brought close to and separated from the outer peripheral surface of the printing cylinder 11 by swinging means, not shown in the drawing, and when occupying a close position, the peeling pawl 31 peels the sheet P away from the outer peripheral surface of the printing cylinder 11. The sheet discharge conveyance unit 32 comprises a drive roller, a driven roller, an endless belt, a suction fan and so on, and conveys the printed sheet P in the direction of an arrow in FIG. 1 while holding the sheet P on the upper surface of the endless belt through suction. The sheet discharge tray 33 has a single end fence and a pair of side fences, and carries the printed sheet P on its upper surface. The peeling fan 34 is disposed above the peeling pawl 31 and blows air toward the outer peripheral surface of the printing cylinder 11 to lift up the tip end of a sheet P that has completed the front surface printing process and been peeled away from the outer peripheral surface of the printing cylinder 11 by the switching member 10 and the tip end of a sheet P that has completed the rear surface printing process and been peeled away from the outer peripheral surface of the printing cylinder 11 by the peeling pawl 31.

The image reading unit 7 is disposed in the upper portion of the apparatus main body. The image reading unit 7 comprises a contact glass, not shown in the drawing, a pressure plate, not shown in the drawing, which is provided so as to be free to contact and separate from the contact glass, a reflection mirror and a fluorescent lamp, not shown in the drawing, for scanning and reading an original image respectively, a lens, not shown in the drawing, for condensing the scanned image, an image sensor, not shown in the drawing, for processing the condensed image, and so on.

Figure 2:
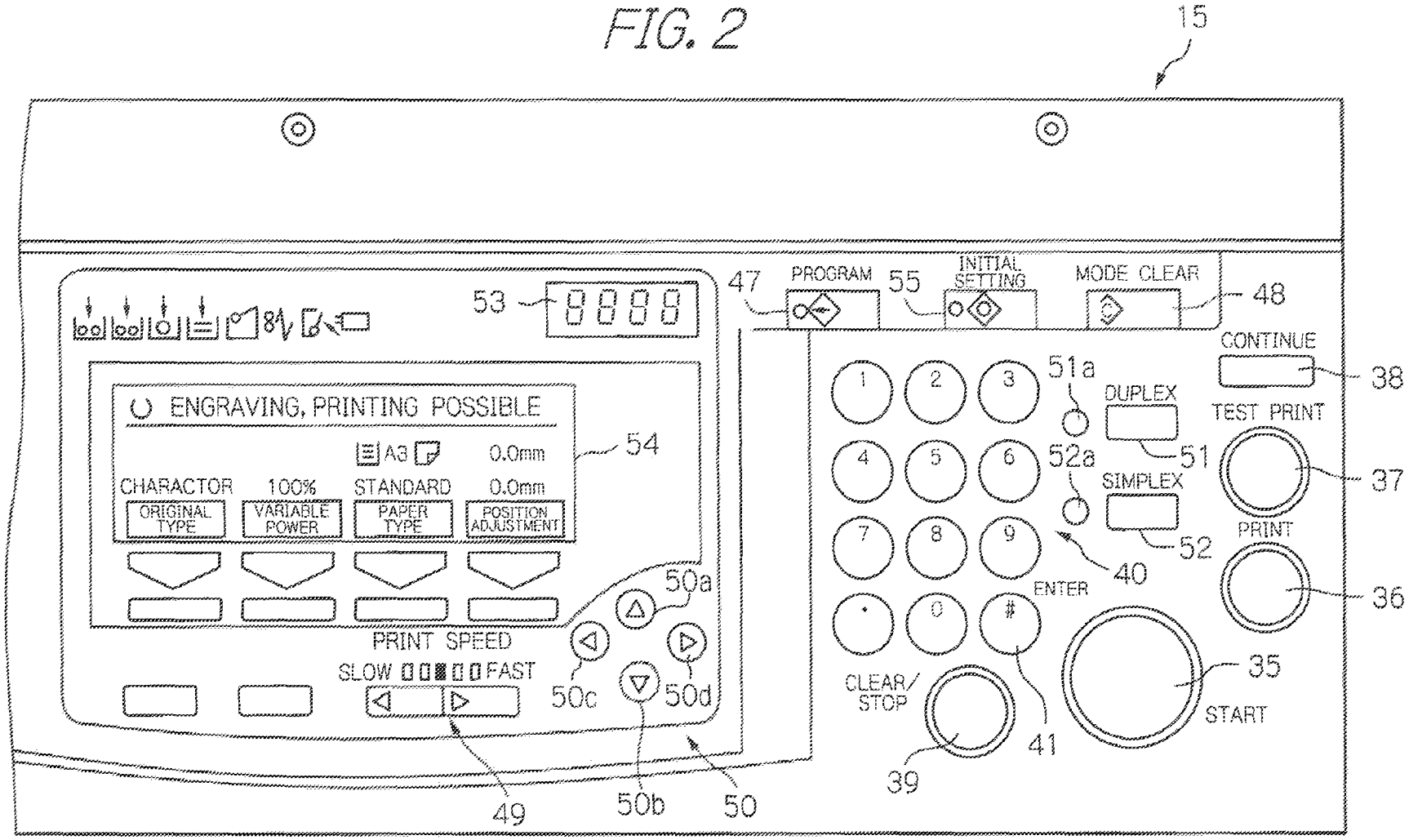
FIG. 2 is a schematic diagram of an operating panel on the stencil printing apparatus.

FIG. 2 shows an operating panel of the stencil printing apparatus 1. In the drawing, an operating panel 15 is provided on a front surface of the upper portion of the apparatus main body 42, and comprises on its upper surface an engraving start key 35, a printing start key 36, a test print key 37, a continue key 38, a clear/stop key 39, a numeric keypad 40, an enter key 41, a program key 47, a mode clear key 48, a printing speed setting key 49, four direction keys 50, a duplex printing key 51, a simplex printing key 52, a display device 53 constituted by a seven-segment LED, a display device 54 constituted by an LCD, an initial setting key 55 and so on. The four direction keys 50 include an up key 50*a*, a down key 50*b*, a left key 50*c* and a right key 50*d*, and are depressed when adjusting the image position during image editing, when selecting a numerical value or an item during setting of various types, and so on. The duplex printing key 51 is pressed before pressing the engraving start key 35 when the stencil printing apparatus 1 is to perform a duplex printing operation. When the duplex printing key 51 is depressed, an LED 51*a* disposed in the vicinity thereof is illuminated to indicate to the operator that a duplex printing mode has been selected. Similarly to the duplex printing key 51, the simplex printing key 52 is pressed before pressing the engraving start key 35 when the stencil printing apparatus 1 is to perform a simplex printing operation. When the simplex printing key 52 is depressed, an LED 52*a* disposed in the vicinity thereof is illuminated to indicate to the operator that a simplex printing mode has been selected. When the stencil printing apparatus 1 is in an initial state, the LED 52*a* is illuminated, indicating that the simplex printing mode is selected.

Figure 3:
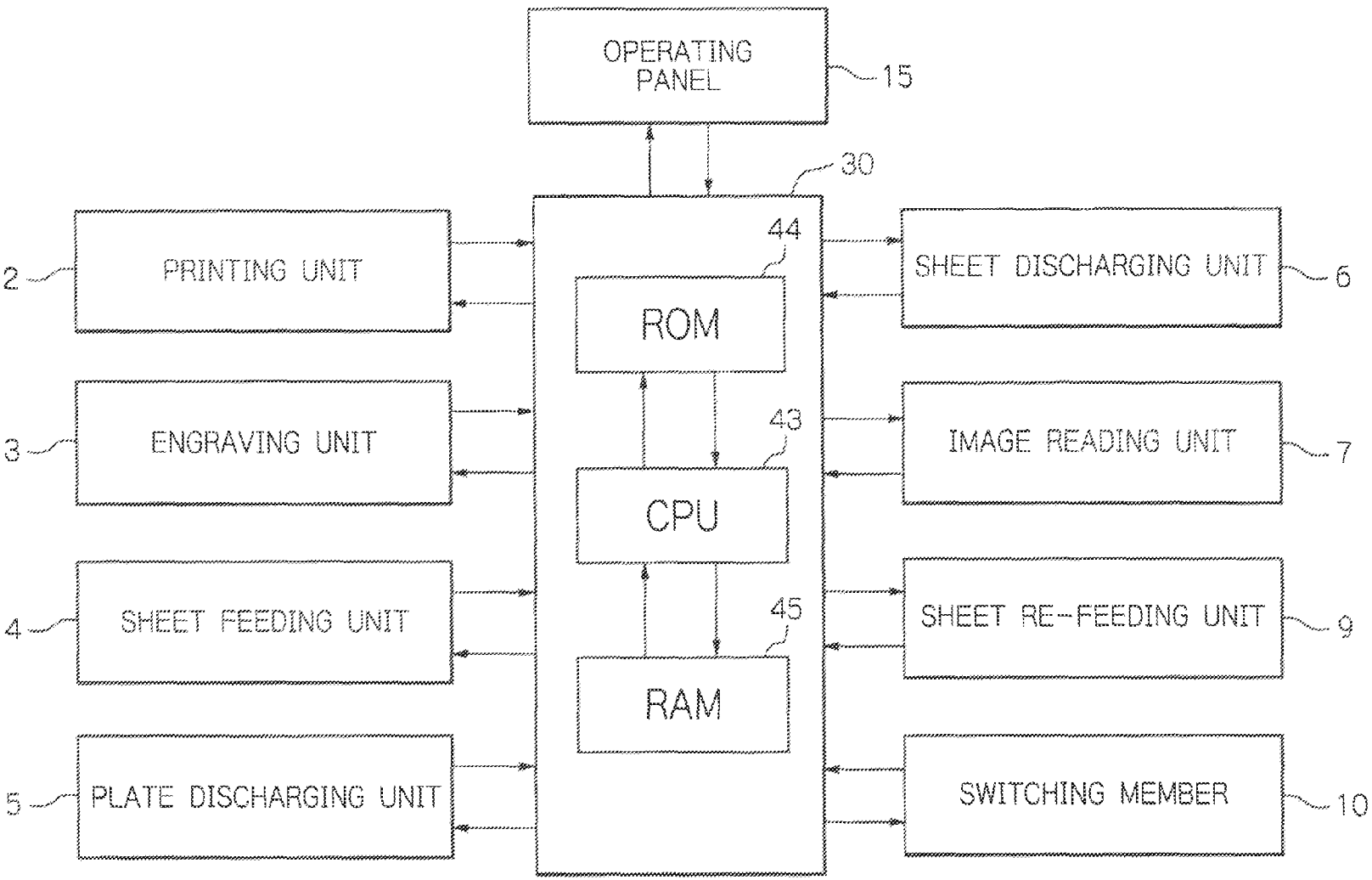
FIG. 3 is a block diagram of control means of the stencil printing apparatus.

FIG. 3 shows the constitution of control means used in the stencil printing apparatus 1. In the drawing, control means 30 are constituted by a micro-computer comprising in its interior a CPU 43, ROM 44, RAM 45 and so on. The control means 30 control the respective operations of the printing unit 2, engraving unit 3, paper feeding unit 4, plate discharge unit 5, sheet discharge unit 6, image reading unit 7, sheet re-feeding means 9, and switching member 10 on the basis of operation signals from the rotary encoder, not shown in the drawing, and the operating panel 15. The ROM 44 stores an operating program of the stencil printing apparatus 1, while the RAM 45 stores various numerical values, information and so on temporarily. The CPU 43 controls an operation of the stencil printing apparatus 1 on the basis of the numerical values, information and so on stored in the RAM 45 and the operating program accessed from the ROM 44.

An operation of the stencil printing apparatus 1 when duplex printing is performed by pressing the duplex printing key 51 will be described below on the basis of the above constitution.

When an original is set on the image reading unit 7 and the engraving start key 35 is pressed by the operator, an original image reading operation is performed in the image reading unit 7, and the plate discharge unit 5 is activated such that the used divided engraved master 14 is peeled away from the outer peripheral surface of the printing cylinder 11. Following plate discharge, the engraving unit 3 is activated to make a new divided engraved master 14, and the new divided engraved master 14 is wrapped around the printing cylinder 11.

When the wrapping operation is complete and the stencil printing apparatus 1 has entered a state of printing standby, various printing conditions are set. Then, when the operator presses the printing start key 36, the printing cylinder 11 is driven to rotate at a set speed, and one sheet P is separated and fed by the sheet feeding unit 4. The fed sheet P is halted temporarily by the resist roller pair 46, and then conveyed between the printing cylinder 11 and press roller 12 at a predetermined timing.

When the printing cylinder 11 has rotated to a predetermined angle such that a front surface region thereof occupies a position corresponding to the press roller 12, the press roller 12 occupies the pressing position, and therefore the sheet P is pressed against the divided engraved master 14 on the printing cylinder 11. As a result, the front surface image is transferred onto one surface of the sheet P. When front surface printing is complete, the tip end portion of the sheet P is lifted by a blast of air from the peeling fan 34. The sheet P is then peeled away from the outer peripheral surface of the printing cylinder 11 by the tip end of the switching member 10 occupying the second position, and conveyed to the sheet re-feeding conveyance unit 19. At this time, the tip end of the sheet P is received by the sheet receiving plate 21, and hence the sheet P is placed on the auxiliary tray 8 from the rear end side. The sheet P on the auxiliary tray 8 is then conveyed in the direction of the arrow in FIG. 1 by the sheet re-feeding conveyance unit 19 and held temporarily with the tip end thereof abutting against the sheet re-feeding positioning member 20.

While the first sheet P is guided onto the auxiliary tray 8, the printing cylinder 11 continues to rotate, and at the same timing as the first sheet P, a second sheet P is fed from the sheet feeding unit 4. Similarly to the first sheet P, the front surface image is transferred onto one surface of the second sheet P, which is fed by the resist roller pair 46, by the press roller 12, whereupon the second sheet P is conveyed to the sheet re-feeding conveyance unit 19 by the switching member 10 occupying the second position.

After the second sheet P has been fed from the sheet feeding unit 4, the sheet re-feeding resist roller 18 is activated at a slightly earlier timing than the timing at which the rear surface region of the printing cylinder 11 reaches the position corresponding to the press roller 12, whereby the first sheet P stored on the auxiliary tray 8 is pressed against the peripheral surface of the press roller 12. The first sheet P pressed against the peripheral surface of the press roller 12 is conveyed toward a position of contact with the printing cylinder 11 by the rotational force of the press roller 12, which is rotated by being pressed against the printing cylinder 11, and when the first sheet P is pressed against the divided engraved master 14, the rear surface image is transferred onto the other surface thereof.

When the rear surface image has been transferred onto the first sheet P such that duplex printing thereof is complete, the first sheet P is guided to the sheet discharge unit 6 by the switching member 10 occupying the first position. The tip end portion of the first sheet P is lifted by a blast of air from the peeling fan 34, whereupon the sheet P is peeled away from the outer peripheral surface of the printing cylinder 11 by the tip end of the peeling pawl 31. Having been peeled away, the printed sheet P is conveyed to the sheet discharge conveyance unit 32, and then conveyed in the direction of the arrow in FIG. 1 so as to be discharged and stacked on the sheet discharge tray 33. The operation described above is repeated until a set number of sheets to be printed is exhausted. When the set number of sheets is reached, operations at each site are halted and the printing operation is terminated.

Next, a setting operation for setting the positions of the front surface image and the rear surface image on the sheet P during the above duplex printing operation will be described.

Figure 4:
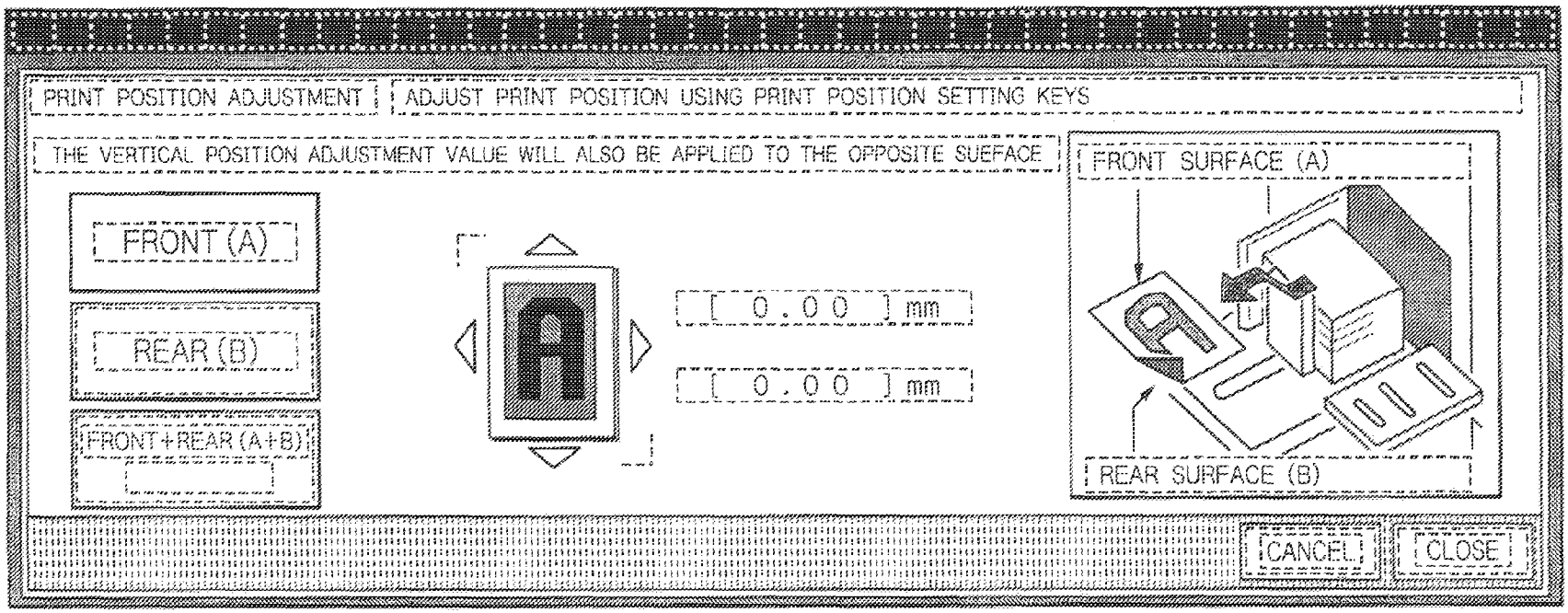
FIG. 4 is a schematic diagram showing an operating panel display during image position setting in the stencil printing apparatus.

When the initial setting key 55 on the operating panel 15 is depressed, an image position adjustment amount setting screen shown in FIG. 4 is displayed on the display device 54. The operator touches a location on the display device 54 corresponding to the side to which the image is to be moved, and then sets the movement amount using the four direction keys 50. In this embodiment, the movement amount is set to increase 0.25 mm every time one of the four direction keys 50 is pressed. For example, when only the front surface image is to be moved 0.5 mm downstream in the sheet conveyance direction, the operator presses the location displaying "front surface (A)" on the display device 54, then presses the left key 50*c* twice, and finally presses the enter key 41. Next, when the operator presses the test print key 37, a single sheet P is conveyed toward the printing unit 2 by the sheet feeding unit 4, and test printing is performed. During test printing, the operation timing of the resist roller pair 46 is delayed by a period corresponding to 0.5 mm in relation to the duplex printing operation described above, and as a result, the position of the front surface image to be transferred onto the sheet P deviates 0.5 mm downstream in the sheet conveyance direction.

When the rear surface image is also to be moved, in this case by 0.5 mm upstream in the sheet conveyance direction, from the state described above, the operator presses the location displaying "rear surface (B)" on the display device 54, then presses the right key 50*d* twice, and finally presses the enter key 41. Then, when the test print key 37 is depressed, the operation timing of the resist roller pair 46 is delayed by a period corresponding to 0.5 mm in relation to the duplex printing operation described above such the position of the front surface image to be transferred onto the sheet P deviates 0.5 mm downstream in the sheet conveyance direction, and the operation timing of the re-feeding resist roller 18 is advanced by a period corresponding to 0.5 mm such that the position of the rear surface image to be transferred onto the sheet P deviates 0.5 mm upstream in the sheet conveyance direction. Note that when the rear surface image alone is to be moved from the state described above, the initial setting key 55 is depressed to initialize the display on the display device 54 (to the state shown in FIG. 4). The location displaying "rear surface (B)" on the display device 54 is then depressed, after which the movement amount may be set.

When the front surface image and rear surface image are to be moved another 2.0 mm downstream in the sheet conveyance direction from the state described above, the operator presses the location displaying "front+rear surfaces (A+B)" on the display device 54, then presses the left key 50*c* eight times, and finally presses the enter key 41. The positions of the images relative to the standard positions at this time are set such that the front surface image deviates 0.5 mm+2.0 mm=2.5 mm toward the downstream side of the sheet conveyance direction while the rear surface image deviates 0.5 mm upstream in the sheet conveyance direction+2.0 mm downstream in the sheet conveyance direction=1.5 mm downstream in the sheet conveyance direction. When the test print key 37 is depressed thereafter, the operation timing of the resist roller pair 46 is delayed by a period corresponding to 2.5 mm in relation to the duplex printing operation described above such the position of the front surface image to be transferred onto the sheet P deviates 2.5 mm downstream in the sheet conveyance direction, and the operation timing of the re-feeding resist roller 18 is delayed by a period corresponding to 1.5 mm such that the position of the rear surface image to be transferred onto the sheet P deviates 1.5 mm downstream in the sheet conveyance direction.

In the constitution described above, when the respective image positions are to be moved in a sheet width direction, the operator presses the initial setting key 55, then presses the up key 50*a* or the down key 50*b* a number of times corresponding to the movement amount (one depression produces a movement amount of 0.25 mm), and then presses the enter key 41. Then, when the test print key 37 is depressed, the printing cylinder axial direction moving means, not shown in the drawing, are activated to move the printing cylinder 11 by the specified movement amount in the specified direction. As a result, the positions of the front surface image and rear surface image to be transferred onto the sheet P deviate by the specified amount in the sheet width direction.

According to the constitution described above, the positions of the front surface image and rear surface image to be formed on the sheet P can be set easily, enabling an improvement in workability. Moreover, since the front surface image and rear surface image can be moved together in the same direction and by a predetermined amount, setting mistakes can be prevented, and hence a further improvement in workability can be achieved.

According to the present invention as described above, the positions of a front surface image and a rear surface image to be formed on a sheet of paper can be set easily, enabling an improvement in workability. Moreover, since the front surface image and rear surface image can be moved together in the same direction and by a predetermined amount, setting mistakes can be prevented, and hence a further improvement in workability can be achieved.

Various modifications will become possible for those skilled in the art after receiving the teachings of the present disclosure without departing from the scope thereof.

What is claimed is:

1. A stencil printing apparatus capable of performing duplex printing, in which a front surface printing process for printing a front surface image on one surface of a sheet is performed, said sheet is re-fed, and then a rear surface printing process for printing a rear surface image on the other surface of said sheet is performed, comprising:

a printing unit including a printing cylinder and a pressing device provided to be free to contact and separate from said printing cylinder;

a sheet feeding unit for feeding said sheet toward said printing unit;

a sheet re-feeder that temporarily accommodates said sheet after a printed image is formed on said front surface thereof in said printing unit, and that then re-feeds said sheet toward said printing unit; and a controller configured to control at least the printing unit and the sheet feeding unit to set a position of said front surface image and a position of said rear surface image to be formed on said sheet to be moved together by a predetermined amount in an identical direction side of a sheet conveyance direction based on a single selection of an image position adjustment setting by a user.

2. The stencil printing apparatus as claimed in claim 1, wherein said controller is further configured to set said position of said front surface image and said position of said rear surface image to be formed on said sheet to be moved individually by a predetermined amount in said sheet conveyance direction.

3. The stencil printing apparatus according to claim 2, wherein said controller sets said position of said front surface image and said position of said rear surface image to be formed on said sheet to be moved together by a predetermined amount in an identical direction side of a sheet conveyance direction based on an input by the user on a display.

4. The stencil printing apparatus as claimed in claim 1, wherein said controller is further configured to perform positional adjustment of said front surface image by varying a feed timing of said sheet feeding unit, and to perform positional adjustment of said rear surface image by varying a re-feed timing of said sheet re-feeding means for re-feeding said sheet to said printing unit.

5. The stencil printing apparatus according to claim 1, wherein said controller sets said position of said front surface image and said position of said rear surface image to be formed on said sheet to be moved together by a predetermined amount in an identical direction side of a sheet conveyance direction based on an input by the user on a display.

6. A stencil printing apparatus capable of performing duplex printing, in which a front surface printing process for printing a front surface image on one surface of a sheet is performed, said sheet is re-fed, and then a rear surface printing process for printing a rear surface image on the other surface of said sheet is performed, comprising:

means for printing the front and rear surface images on the sheet;

means for feeding said sheet toward said means for printing;

means for temporarily accommodating said sheet after a printed image is formed on said front surface thereof in said means for printing, and then for re-feeding said sheet toward said means for printing; and control means for controlling at least the printing unit and the sheet feeding unit and for setting a position of said front surface image and a position of said rear surface image to be formed on said sheet to be moved together by a predetermined amount in an identical direction side of a sheet conveyance direction based on a single selection of an image position adjustment setting by a user.

7. The stencil printing apparatus as claimed in claim 6, wherein said control means further sets, said position of said front surface image and said position of said rear surface image to be formed on said sheet to be moved individually by a predetermined amount in said sheet conveyance direction.

8. The stencil printing apparatus according to claim 7, wherein said controller sets said position of said front surface image and said position of said rear surface image to be formed on said sheet to be moved together by a predetermined amount in an identical direction side of a sheet conveyance direction based on an input by the user on a display.

9. The stencil printing apparatus as claimed in claim 6, wherein said control means performs positional adjustment of said front surface image by varying a feed timing of said means for feeding, and performs positional adjustment of said rear surface image by varying a re-feed timing of said sheet re-feeding means for re-feeding said sheet to said means for printing.

10. The stencil printing apparatus according to claim 6, wherein said control means sets said position of said front surface image and said position of said rear surface image to be formed on said sheet to be moved together by a predetermined amount in an identical direction side of a sheet conveyance direction based on an input by the user on a display.

* * * * *